US009099799B2

(12) United States Patent
Henschel et al.

(10) Patent No.: US 9,099,799 B2
(45) Date of Patent: Aug. 4, 2015

(54) ELECTRICAL TERMINATION UNIT FOR A MICROELECTRONIC DEVICE AND MICROELECTRONIC DEVICE INCLUDING SUCH AN ELECTRICAL TERMINATION UNIT

(71) Applicant: BIOTRONIK SE & Co. KG, Berlin (DE)

(72) Inventors: Martin Henschel, Berlin (DE); Torsten Oertmann, Blankenfelde (DE); Barry Haskins, Woodburn, OR (US)

(73) Assignee: BIOTRONIK SE & Co. KG, Berlin (DE)

( * ) Notice: Subject to any disclaimer, the term of this patent is extended or adjusted under 35 U.S.C. 154(b) by 44 days.

(21) Appl. No.: 13/962,129

(22) Filed: Aug. 8, 2013

(65) Prior Publication Data

US 2014/0065896 A1 Mar. 6, 2014

Related U.S. Application Data

(60) Provisional application No. 61/695,297, filed on Aug. 31, 2012.

(51) Int. Cl.

| | |
|---|---|
| ***H01R 13/02*** | (2006.01) |
| ***H01R 13/20*** | (2006.01) |
| ***H01R 12/53*** | (2011.01) |
| ***H01R 12/72*** | (2011.01) |
| ***H01R 43/02*** | (2006.01) |
| ***H01R 43/20*** | (2006.01) |
| *H01R 4/02* | (2006.01) |

(52) U.S. Cl.

CPC ..... *H01R 13/20* (2013.01); *H01R 12/53* (2013.01); *H01R 12/724* (2013.01); *H01R 13/02* (2013.01); *H01R 43/0249* (2013.01); *H01R 43/205* (2013.01); *H01R 4/023* (2013.01); *H01R 2201/12* (2013.01); *Y10T 29/49149* (2015.01)

(58) Field of Classification Search

CPC ..... H01R 13/20
USPC ..... 439/495, 497, 579, 581, 909
See application file for complete search history.

(56) References Cited

U.S. PATENT DOCUMENTS

| | | | | |
|---|---|---|---|---|
| 3,509,513 | A * | 4/1970 | Russin | 439/468 |
| 3,964,470 | A | 6/1976 | Trombley | |

(Continued)

FOREIGN PATENT DOCUMENTS

| | | |
|---|---|---|
| DE | 82 13 805.2 | 8/1982 |
| DE | 10 2010 007 597 | 9/2010 |

(Continued)

OTHER PUBLICATIONS

European Search Report and Annex to the European Search Report on European Patent Application No. EP 13 17 9853, dated Aug. 21, 2014 (8 pages).

*Primary Examiner* — James Harvey
(74) *Attorney, Agent, or Firm* — Buchanan Ingersoll & Rooney PC

(57) ABSTRACT

An electrical termination unit for a microelectronic device, the electrical termination unit including, a carrier; and at least one metal tab being attached to the carrier; wherein the carrier is provided with at least one connection area where one electrical lead is to be electrically connected to one metal tab, and wherein the at least one connection area is configured to retain the least one electrical lead at least in one spatial dimension in a defined position relative to the one metal tab prior to a metallurgical connection process.

15 Claims, 5 Drawing Sheets

(56) References Cited

U.S. PATENT DOCUMENTS

| | | | | |
|---|---|---|---|---|
| 6,302,736 | B1 * | 10/2001 | Nishio et al. | 439/596 |
| 6,338,652 | B1 * | 1/2002 | Ko | 439/579 |
| 6,338,653 | B1 * | 1/2002 | Jones et al. | 439/579 |
| 6,517,392 | B2 * | 2/2003 | Murakami et al. | 439/877 |
| 6,629,850 | B2 * | 10/2003 | Kato et al. | 439/76.2 |
| 8,192,223 | B2 * | 6/2012 | Bishop | 439/404 |
| 8,696,378 | B2 * | 4/2014 | Behziz et al. | 439/497 |
| 2002/0039848 | A1 | 4/2002 | Chiang | |
| 2010/0249861 | A1 * | 9/2010 | Iyer et al. | 607/9 |
| 2011/0170269 | A1 | 7/2011 | Blossfeld et al. | |
| 2014/0065896 | A1 * | 3/2014 | Henschel et al. | 439/889 |

FOREIGN PATENT DOCUMENTS

| | | |
|---|---|---|
| EP | 2 418 738 | 2/2012 |
| JP | H11 026048 | 1/1999 |

* cited by examiner

ELECTRICAL TERMINATION UNIT FOR A MICROELECTRONIC DEVICE AND MICROELECTRONIC DEVICE INCLUDING SUCH AN ELECTRICAL TERMINATION UNIT

CROSS-REFERENCE TO RELATED APPLICATIONS

This patent application claims the benefit of U.S. Provisional Patent Application No. 61/695,297, filed on Aug. 31, 2012, which is hereby incorporated herein by reference in its entirety.

TECHNICAL FIELD

The present invention relates to an electrical termination unit for a microelectronic device and a microelectronic device having at least one such electrical termination unit, particularly for implantable medical devices.

BACKGROUND

U.S. Publication No. 2011/0170269 discloses an electronic assembly comprising a printed circuit board and a compliant pin header assembly in a housing. The compliant pin header assembly is mountable in the housing by inter-engaging features on the header assembly and the housing. The compliant pin header assembly has compliant pins for engaging corresponding features on the printed circuit board.

For establishing final metallurgical connections of a wire array to an array of electrical contacts it is necessary to maintain an alignment of terminations during metallurgical attachment such as, for example, welding, brazing, soldering, etc. Existing solutions in the art require complex tooling and/or manual intervention by an operator. The operator with a tool, e.g., tweezers, must secure the termination while performing the attachment process. Imperfections that may result include, but are not limited to, misalignment of terminations and separation of terminations. Misalignment can lead to high-voltage arcing or shorting. Partial separation can create a high-impedance connection. Full separation can cause complete malfunction. Accordingly, time consuming and costly detailed visual inspections are a part of the known electronic assembly operation.

Existing connector solutions are too volumetrically large for some microelectronic assemblies, e.g., implantable medical devices, and are generally incompatible with creating the final metallurgical connection.

The present invention is directed toward overcoming one or more of the above-identified problems.

SUMMARY

It is an object of the present invention to provide an electrical termination unit which facilitates establishment of electrical termination connections, particularly for a semi-automated or automated metallurgical connection process.

Another object is to provide a microelectronic device having such an electrical termination arrangement.

Another object is to provide a method for manufacturing an electronic device, particularly a microelectronic device.

At least the above objects are achieved by the features of the independent claim(s). The other dependent claims, the description and the drawings provide advantageous developments of the present invention.

In a first aspect of the present invention, an electrical termination unit for a microelectronic device is proposed, the electrical termination unit comprising a carrier;

at least one metal tab being attached to the carrier;

wherein the carrier is provided with at least one connection area where one electrical lead is to be electrically connected to the at least one metal tab, and wherein the at least one connection area is configured to retain the at least one electrical lead at least in one spatial dimension in a defined position related to the one metal tab prior to a metallurgical connection process.

Advantageously, the carrier may be made from an insulating material, preferably selected from the group consisting of polymeric materials or ceramic materials, or both. Such polymers may include, but are not limited to, liquid crystal polymer (LCP), polybenzimidazole (PBI), polyetheretherketone (PEEK), and polyetherketoneketone (PEKK). And such ceramic materials may include, for example, aluminum oxide ($Al_2O_3$), which is a suitable ceramic.

Favorably, the wire can be securely positioned prior to metallurgically connecting the components without the need of an operator aligning the wire. The present invention is particularly advantageous for preparing the metallurgical connection of a multitude of wires to an array of metal tabs.

According to an advantageous embodiment, the carrier may be provided with at least one opening through which the metal tab extends and exposes its free ends at different sides of the carrier. The arrangement is particularly useful for establishing multiple metallurgical connections at once.

According to an advantageous embodiment, the at least one connection area may be provided in a recess of the carrier in which recess the metal tab is accessible for the electric lead. The recess is favorable for aligning the wire with respect to the metal tab.

According to an advantageous embodiment, the at least one connection area may be confined at least on two sides by an alignment feature for aligning the electric lead with respect to the metal tab. These adjacent alignment features can be easily manufactured. The adjacent alignment features ensure proper high-voltage separation distances, increasing yield of the inner assembly process of the electrical device, as well as improved quality and reducing scrap costs.

According to an advantageous embodiment, the at least one connection area may comprise means for accommodating a free end of the electrical lead by way of an interference fit or a transition fit. The free end of the wire is securely fastened in the retention means, thus facilitating the metallurgical connection process following the fastening via interference fit.

According to an advantageous embodiment, a recess may be arranged in a wall of the carrier in proximity to the metal tab which receives the free end of the electrical lead and retains the electrical lead with the interference fit or the transition fit. The free end of the wire is securely fastened in the recess, thus facilitating the metallurgical connection process following the fastening via interference fit or via transition fit. An interference fit in the sense of this application, also known as a press fit or friction fit, is a fastening between two parts which is achieved by friction after the parts are pushed together, rather than by any other means of fastening. Therefore, in the sense of this application it is used as a "high stress fit". A "transition fit" is an interference fit with varying tolerances so that it is used in the sense of this application as a "low stress fit" or "no stress fit".

According to an advantageous embodiment, the metal tab may be folded in a way to provide a recess for receiving the free end of the electrical lead and retaining the free end with the interference fit or with the transition fit. The free end of the wire is securely fastened in the recess thus facilitating the metallurgical connection process following the fastening via the interference fit or via the transition fit.

According to an advantageous embodiment, the metal tab may be forked to provide a recess for receiving the free end of the electrical lead and retaining the free end with the interference fit or with the transition fit. The free end of the wire is securely fastened in between two sides of the forked metal tab thus facilitating the metallurgical connection process following the fastening via the interference fit or via the transition fit.

According to an advantageous embodiment, the metal tab may be provided with a pin which cooperates with an opening in the electrical lead for retaining the electrical lead with the interference fit or with the transition fit. The free end of the wire is securely fastened to the pin of the metal tab thus facilitating the metallurgical connection process following the fastening via the interference fit or via the transition fit.

According to an advantageous embodiment, a multitude of metal tabs may be arranged in the carrier. In one example of this embodiment, the metal tabs may be arranged in the carrier spaced from one another, preferably equally spaced from one another. The arrangement of this embodiment allows for preparing large number of electrical contacts at once.

In another aspect of the present invention, an electrical device comprising at least one termination unit according to the first aspect of the present invention is provided. The electrical termination unit can be manufactured with small dimensions; bulky connectors are not necessary.

According to an advantageous embodiment, the electrical device may be a microelectronic device, particularly a medical device, intended for implantation into a human or animal body. The electrical device can be manufactured with advantageous small dimensions.

In another aspect of the present invention, a method for manufacturing an electrical device comprising at least one electrical termination unit is proposed, including the steps of:

- providing a carrier and at least one metal tab;
- forming the electrical termination unit by attaching the at least one metal tab to the carrier;
- attaching the electrical termination unit to a printed circuit board;
- attaching one or more wires connected to one or more components coupled to the printed circuit board to one or more retention means provided by the electrical termination unit, thus securing the one or more wires with an interference fit or with a transition fit to the retention means;
- performing a thermal process for metallurgically bonding the one or more wires to one or more metal tabs accommodated in the carrier.

The method allows for convenient preparation and prearranging wires with respect to metal tabs prior to a metallurgical connection process. Self-fixation of the wires in the retention means enables automated metallurgical processes, such as, for example, laser welding, brazing, soldering, or the like, of other device elements, such as, e.g., battery and charge capacitors connections, to an electronic module. This allows for more devices to be manufactured in the same amount of time and with greater consistency, resulting in an increased output at lower costs.

According to an advantageous embodiment, the thermal process may be performed in a manual, semi-automated or automated way for metallurgically bonding a multitude of wires to the electrical termination unit.

Further features, aspects, objects, advantages, and possible applications of the present invention will become apparent from a study of the exemplary embodiments and examples described below, in combination with the figures, and the appended claims.

DESCRIPTION OF THE DRAWINGS

The present invention together with the above-mentioned and other objects and advantages may best be understood from the following detailed description of the embodiments, but not restricted to the embodiments, wherein is shown in.

DETAILED DESCRIPTION

Figure 1A:
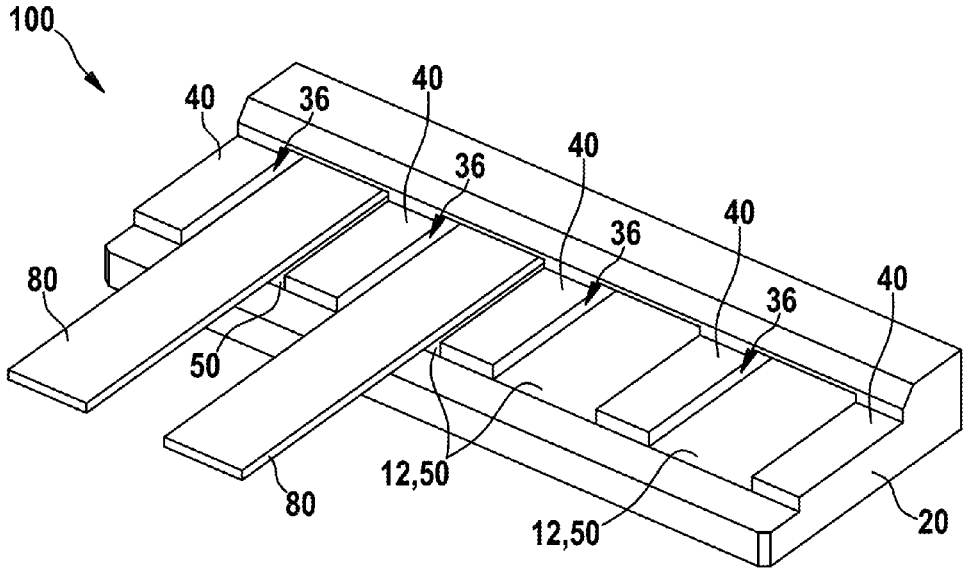
FIG. 1A shows a perspective view of an embodiment of an electrical termination unit having a recess in a carrier providing interference fit for a flat wire.

In the drawings, like elements are referred to with equal reference numerals. The drawings are merely schematic representations, not intended to portray specific parameters of the present invention. Moreover, the drawings are intended to depict only typical embodiments of the present invention and therefore should not be considered as limiting the scope of the present invention.

Figure 1B:
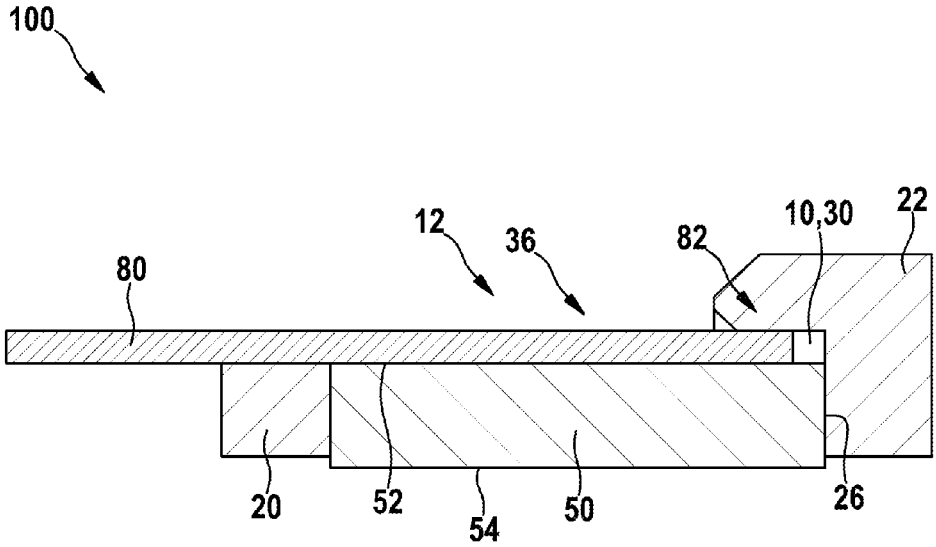
FIG. 1B shows a cut view of the electrical termination unit of FIG. 1A.

FIG. 1A depicts a perspective view of an embodiment of an electrical termination unit 100 having a recess 30 in a carrier 20 providing an interference fit for a flat wire 80. FIG. 1B shows a cut view of the electrical termination unit 100 of FIG. 1A.

The electrical termination unit 100 comprises a carrier 20 and at least one metal tab 50 being attached to the carrier 20. The carrier 20 is provided with at least one connection area 12 where one electrical lead 80 (i.e., wire 80) is to be electrically connected to one metal tab 50. In the example shown, four connection areas 12 each with a metal tab 50 and two flat wires 80 arranged in two connection areas 12 are illustrated.

Each connection area 12 is configured to retain the electrical lead 80 at least in one spatial dimension in a defined position relative to the metal tab 50 prior to a metallurgical connection process. The connection areas 12 are equidistantly separated by alignment features 40. Each connection area 12 is provided with an opening 26 through which the metal tab 50 extends. The metal tab's free ends 52 and 54 are exposed at different sides of the carrier 20, e.g., the upper side and the bottom side. Each connection area 12 is provided in a recess 36 of the carrier 20, where the metal tab 50 is accessible for the electric wire 80. The metal tab 50 is embodied as metallic block. In another construction of this embodiment, connection areas 12 are not equidistantly separated. Particularly, this construction is used if high voltage is applied to one, more, or all of the connection areas 12, or if high voltage is applied in combination with miniaturization of the connection areas 12. In these cases, it is important to increase the creeping distance. Furthermore, in the mentioned construction, alignment features 40 have increased or vary in wall thicknesses. "Wall thickness" in the sense of this application is the distance between two adjacent connection areas 12.

The metal tabs 50 are arranged in the recesses 36 of the carrier 20. The recesses 36 are equally spaced along the carrier 20 and have an open front side and top side each and are closed on two sides by the walls forming the alignment features 40, while the back side of the recess 36 is closed by a wall 22 of the carrier 20. In the construction stated above, recesses 36 are not equidistantly separated. Then the alignment features 40 between the recesses 36 have varying wall thicknesses.

The at least one connection area 12 is confined on two sides by the alignment feature 40 for aligning the electric lead 80 with respect to the metal tab 50. Each connection area 12 comprises retention means 10 for accommodating a free end 82 of the electrical wire 80 by way of an interference fit. In this example, the retention means 10 are assigned to the carrier 20.

An interference fit is established via a recess 30 arranged in a wall 22 of the carrier 20 in proximity of the metal tab 50. The wire 80 is pushed with its free end 82 parallel to the upper free end 52 of the metal tab 50 into the recess 30. The recess 30 receives the free end 82 of the electrical lead 80 and securely retains the electrical lead 80. The recess 30 secures the flat wire 80 in its z-position, while the alignment features secure the flat wire 80 in its xy-position. The z-position in the sense of this application is the position in which the flat wire 80 is secured in a direction vertically to its flat side, while the xy-position is the secured position along the plane of the flat side of flat wire 80.

When all wires 80 are arranged in the retention means 10, an automated metallurgical process can be performed which establishes a fixed material connection between each wire 80 and corresponding metal tab 50.

Figure 2A:
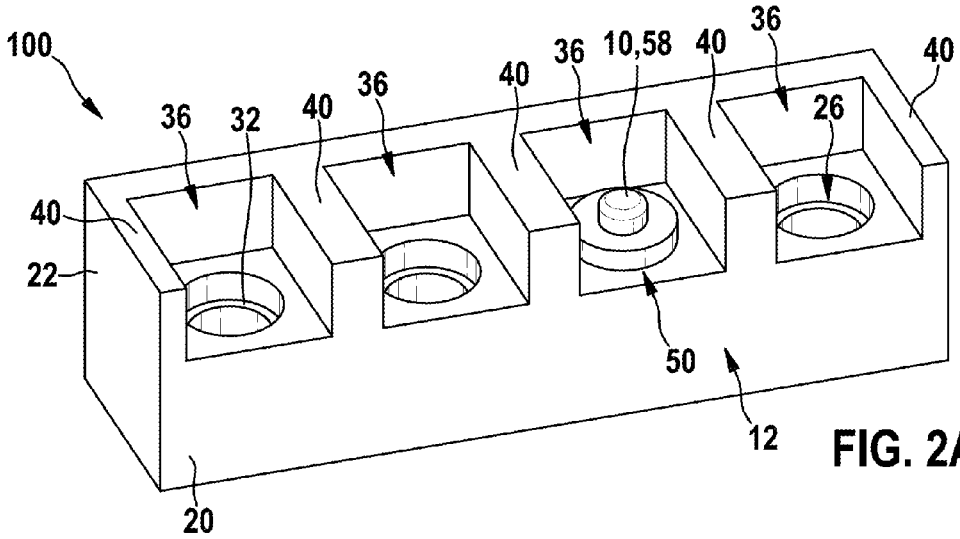
FIG. 2A shows a perspective view of an embodiment of an electrical termination unit having a metal tab with a pin providing interference fit for a flat wire.
Figure 2B:
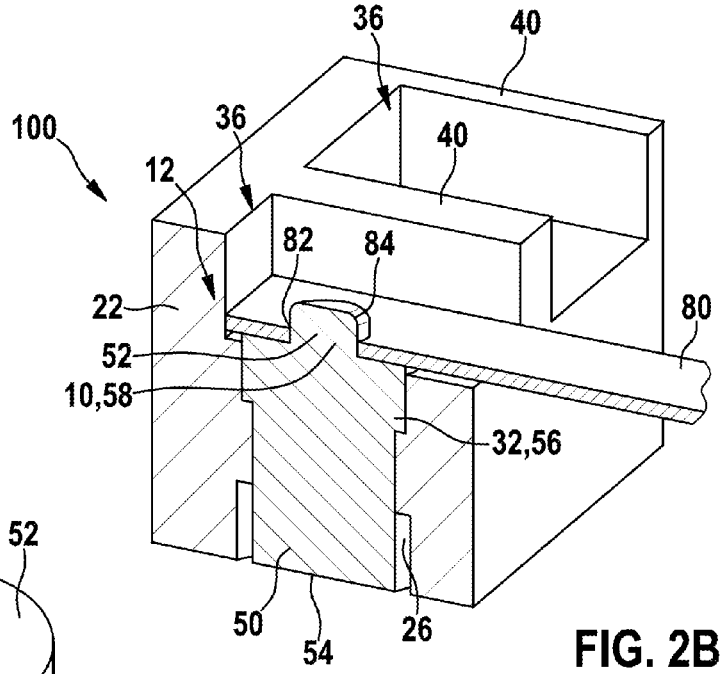
FIG. 2B shows a cut view of the electrical termination unit of FIG. 2A.
Figure 2C:
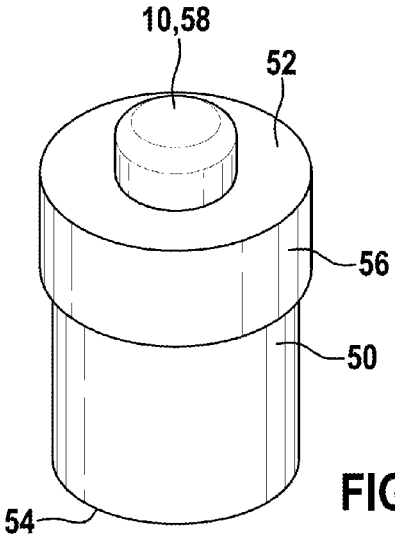
FIG. 2C shows a perspective view of a metal tab with a pin.

FIG. 2A depicts a perspective view of an embodiment of an electrical termination unit 100 having metal tabs 50 providing a protruding pin 58 as retention means 10 providing interference fit for a flat wire 80. FIG. 2B shows a cut view of the electrical termination unit 100 of FIG. 2A. FIGS. 2A-C show a metal tab 50.

The electrical termination unit 100 comprises a carrier 20 and at least one metal tab 50 being attached to the carrier 20. The carrier 20 is provided with at least one connection area 12 where one electrical lead 80 (i.e., wire 80) is to be electrically connected to one metal tab 50. In the example shown, four equally spaced connection areas 12 are shown with one metal tab 50 depicted being arranged in one of the connection areas 12. In another construction, connection areas 12 are not equally spaced, especially in the case of applying high voltage to one or more of the connection areas 12.

Each connection area 12 is configured to retain the electrical wire 80 at least in one spatial dimension in a defined position relative to the metal tab 50 prior to a metallurgical connection process. The connection areas 12 are equidistantly separated by alignment features 40. For example, in the construction stated above, connection areas 12 are not equidistantly separated by alignment features 40 with varying wall thicknesses. Each connection area 12 is provided with an opening 26 through which the metal tab 50 extends. The metal tab's free ends 52 and 54 are exposed at different sides of the carrier 20, e.g., the upper side and the bottom side. Each connection area 12 is provided in a recess 36 of the carrier 20, where the metal tab 50 is accessible for the electric wire 80. In the embodiment shown, the metal tab 50 is embodied as a metallic cylinder.

The recesses 36 have an open front side and an open top side and are closed on two sides by the walls forming the alignment features 40, while the back side of the recess 36 is closed by a wall 22 of the carrier 20, and are accessible from the top and the bottom.

The at least one connection area 12 is confined on two sides by the alignment feature 40 for aligning the electric lead 80 with respect to the metal tab 50. The alignment features 40 are embodied as walls between the recesses 36. Each connection area 12 comprises means 10 for accommodating a free end 82 of the electrical wire 80 by way of an interference fit. In this example, the retention means 10 is assigned to the metal tab 50.

An interference fit is established via the pin 58 protruding from the top free end 52 of the metal tab 50 with a smaller diameter than the average diameter of the metal tab 50. The wire 80 comprises a bore 84 at its free end 82 and is slipped on the pin 58 of the metal tab 50 so that the pin 58 secures the wire 80 in its z-position, while the alignment features 40 secure the flat wire 80 in its xy-position. The wire 80 rests on a shoulder of the metal tab 50 at the metal tab's free end 52, the shoulder having a larger diameter than the pin 58. Towards the opposite free end 54 of the metal tab 50 an undercut 56 is arranged which corresponds to a step 32 in the opening 26 so that the metal tab 50 is secured in the opening 26 and cannot slip through the opening 26.

When all wires 80 are arranged in the retention means 10, an automated metallurgical process can be performed which establishes a fixed material connection between each wire 80 and corresponding metal tab 50.

Figure 3A:
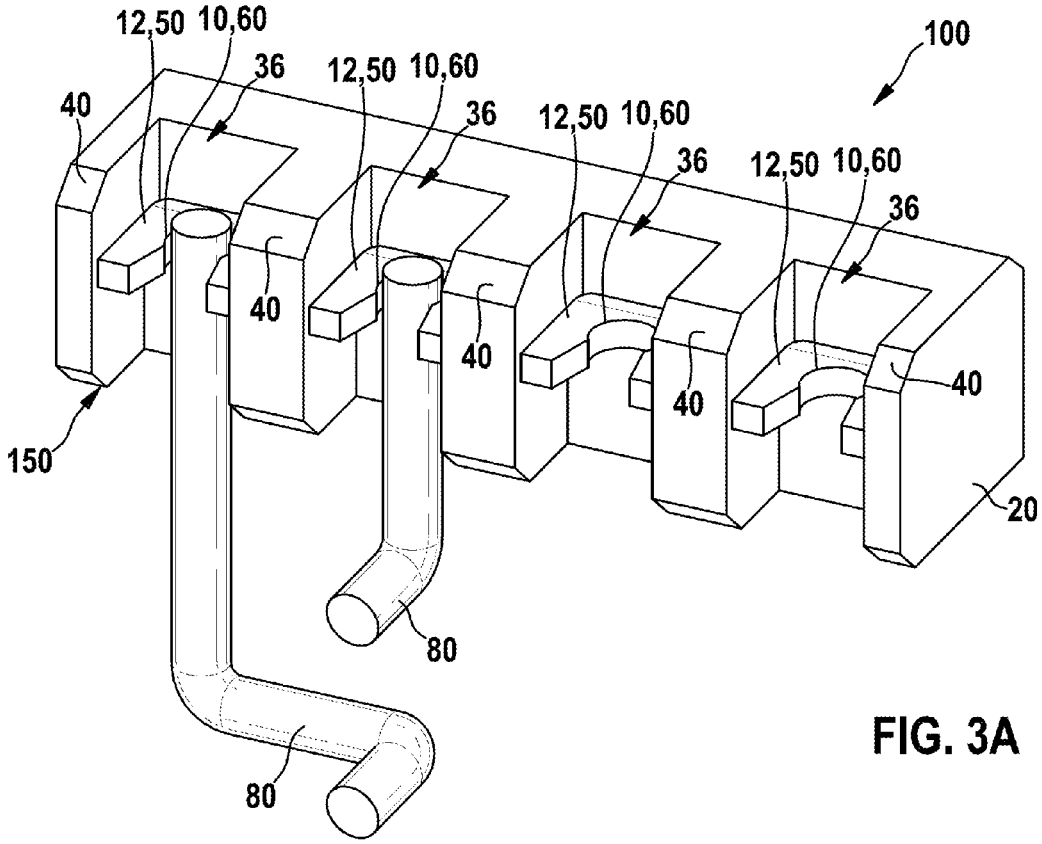
FIG. 3A shows a perspective view of an embodiment of an electrical termination unit having a forked metal tab providing interference fit for a round wire.
Figure 3B:
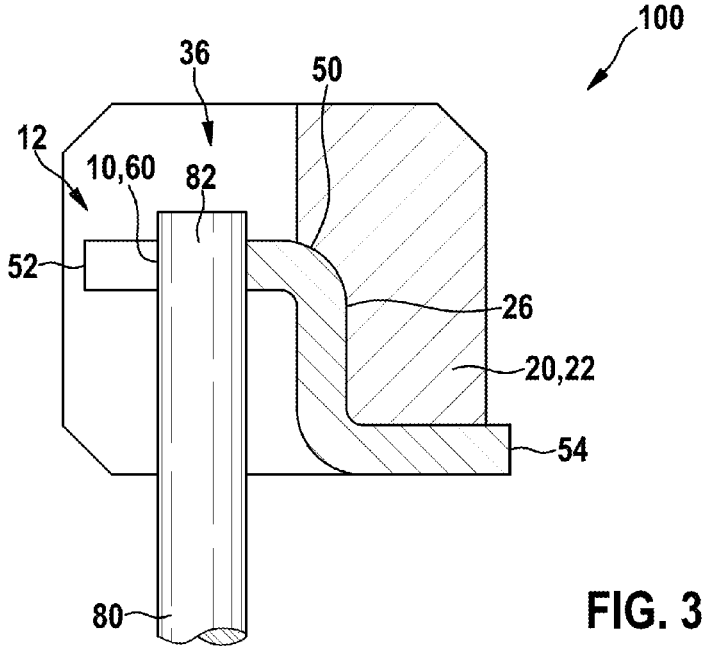
FIG. 3B cut view of the electrical termination unit of FIG. 3A.

FIG. 3A depicts a perspective view of an embodiment of an electrical termination unit 100 having metal tabs 50 providing a receptacle 60 as retention means 10 providing an interference fit for a round wire 80. FIG. 3B shows a cut view of the electrical termination unit 100 of FIG. 3A.

The electrical termination unit 100 comprises a carrier 20 and at least one metal tab 50 being attached to the carrier 20. The carrier 20 is provided with at least one connection area 12 where one electrical lead 80 (i.e., wire 80) is to be electrically connected to one metal tab 50. In the example shown, four equally spaced connection areas 12 are shown. In another construction, connection areas 12 are not equally spaced, especially in the case of applying high voltage to one or more of the connection areas 12. Two wires 80 are depicted, each one attached to another metal tab 50 arranged in the connection areas 12.

Each connection area 12 is configured to retain the electrical wire 80 at least in one spatial dimension in a defined position relative to the metal tab 50 prior to a metallurgical connection process. The connection areas 12 are equidistantly separated by alignment features 40 embodied as walls between recesses 36 in which the connection areas 12 are arranged. For example, in the construction stated above, connection areas 12 are not equidistantly separated by alignment features 40 with varying wall thicknesses. Each connection area 12 is provided with a z-shaped opening 26 through which the metal tab 50 extends. The metal tab's free ends 52 and 54 are exposed at different sides of the carrier 20, e.g., the front side and the rear side. Each connection area 12 is provided in a recess 36 of the carrier 20, where the metal tab 50 is accessible for the electric wire 80. The metal tab 50 is embodied as z-shaped flat wire having a free end 52 formed as a two-pronged fork with the receptacle 60 for the wire 80 arranged between the prongs of the fork.

The recesses 36 have an open front side and an open top side and are closed on two sides by the walls forming the alignment features 40, while the back side of the recess 36 is closed by a wall 22 of the carrier 20, and are accessible from the top and the bottom.

The at least one connection area 12 is confined on two sides by the alignment feature 40 for aligning the electric lead 80 with respect to the metal tab 50. The alignment features 40 are embodied as walls between the recesses 36. Each connection area 12 comprises means 10 for accommodating a free end 82 of the electrical wire 80 by way of an interference fit. In this example, the retention means 10 is assigned to the metal tab 50.

An interference fit is established via the prongs of the forked metal tab 50 protruding from the free end 52 of the metal tab 50. The wire 80 is slipped between the prongs of the forked metal tab 50 so that the wire 80 is secured in its z-position, while the alignment features 40 secure the flat wire 80 in its xy-position.

When all wires 80 are arranged in the retention means 10, an automated metallurgical process can be performed which establishes a fixed material connection between each wire 80 and corresponding metal tab 50.

Figure 4A:
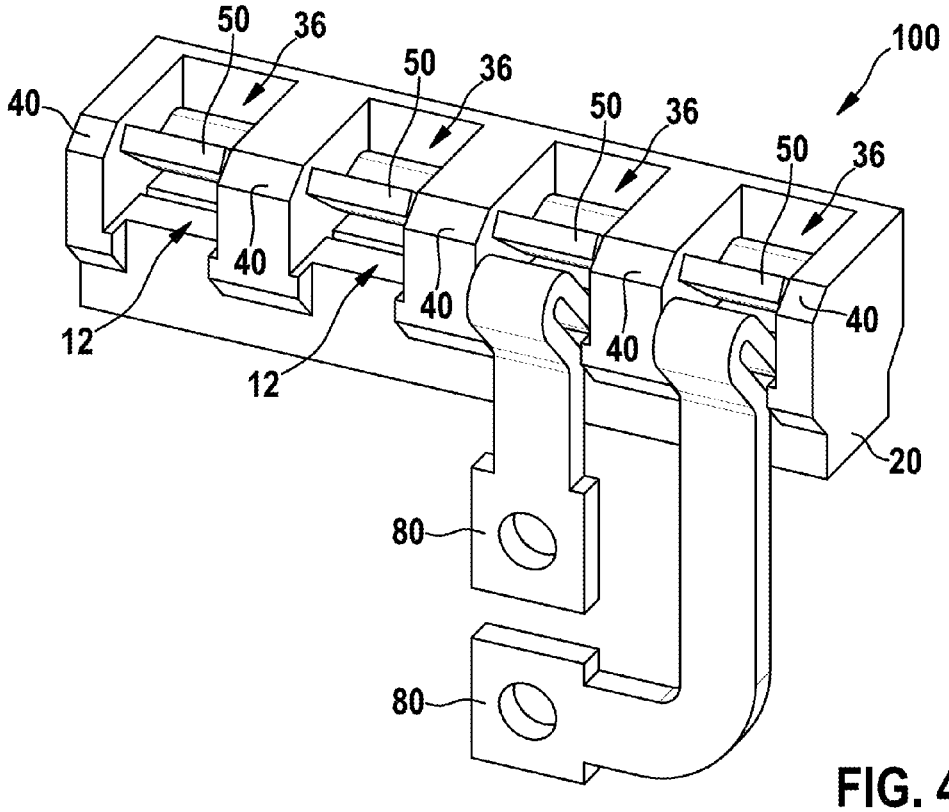
FIG. 4A shows a perspective view of an embodiment of an electrical termination unit having a metal tab providing a recess which provides interference fit for a flat wire.
Figure 4B:
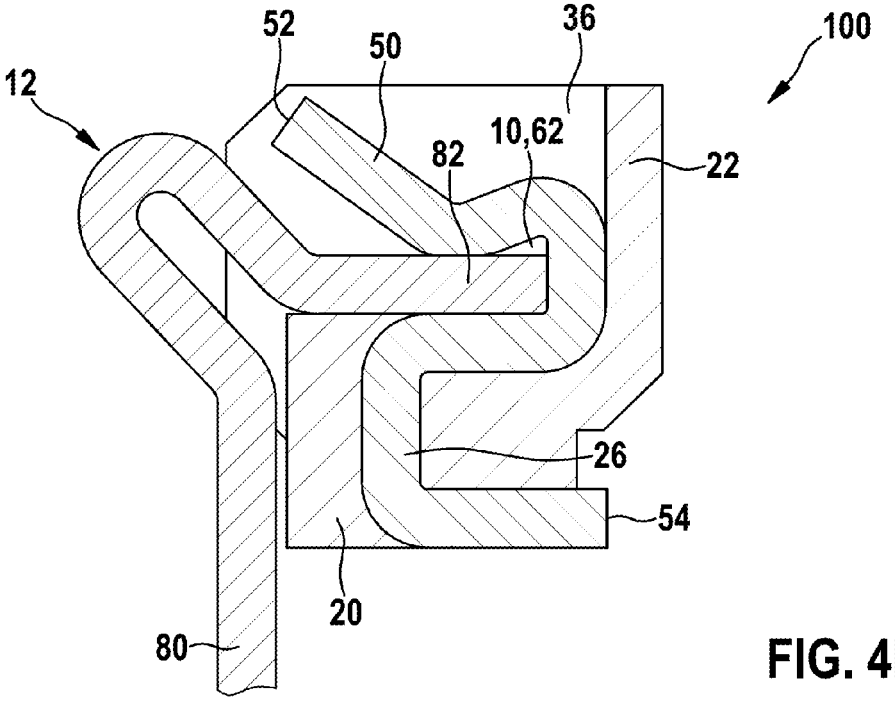
FIG. 4B shows a cut view of the electrical termination unit of FIG. 4A.

FIG. 4A depicts a perspective view of an embodiment of an electrical termination unit 100 having metal tabs 50 providing a recess 62 as retention means 10 providing an interference fit for a flat wire 80. FIG. 4B shows a cut view of the electrical termination unit 100 of FIG. 4A.

The electrical termination unit 100 comprises a carrier 20 and at least one metal tab 50 being attached to the carrier 20. The carrier 20 is provided with at least one connection area 12 where one electrical lead 80 (i.e., wire 80) is to be electrically connected to one metal tab 50. In the example shown, four equally spaced connection areas 12 are shown. In another construction, connection areas 12 are not equally spaced, especially in the case of applying high voltage to one or more of the connection areas 12. Two wires 80 are depicted, each one attached to another metal tab 50 arranged in connection areas 12.

Each connection area 12 is configured to retain the electrical wire 80 at least in one spatial dimension in a defined position related to the metal tab 50 prior to a metallurgical connection process. The connection areas 12 are equidistantly separated by alignment features 40 embodied as walls between recesses 36 in which the connection areas 12 are arranged. For example, in the construction stated above, connection areas 12 are not equidistantly separated by alignment features 40 with varying wall thicknesses.

Each connection area 12 is provided with a roughly z-shaped opening 26 through which the metal tab 50 extends. The metal tab's free ends 52 and 54 are exposed at different sides of the carrier 20, e.g., the front side and the rear side. Each connection area 12 is provided in a recess 36 of the carrier 20, where the metal tab 50 is accessible for the electric wire 80. The recesses 36 are open to the front side of the electrical termination unit 100 and closed on both sides by the walls forming the alignment features 40, while the back side of the recess 36 is closed by a wall 22 of the carrier 20.

The metal tab 50 is embodied as z-shaped flat wire. The metal tab is bent in a way to provide a recess 62 between segments of the metal tab 50. The recess 62 is supported by the wall 22 of the carrier 20.

The at least one connection area 12 is confined on two sides by the alignment feature 40 for aligning the electric lead 80 with respect to the metal tab 50. The alignment features 40 are embodied as walls between the recesses 36.

Each connection area 12 comprises means 10 for accommodating a free end 82 of the electrical wire 80 by way of an interference fit. In this example, the retention means 10 is assigned to the metal tab 50.

An interference fit is established via the prongs of the forked metal tab 50 protruding from the free end 52 of the metal tab 50. The wire 80 is slipped with its free end 82 into the recess 62 formed in the metal tab 50 so that the wire 80 is secured in its z-position, while the alignment features 40 secure the flat wire 80 in its xy-position.

When all wires 80 are arranged in the retention means 10, an automated metallurgical process can be performed which establishes a fixed material connection between each wire 80 and corresponding metal tab 50.

Figure 5:
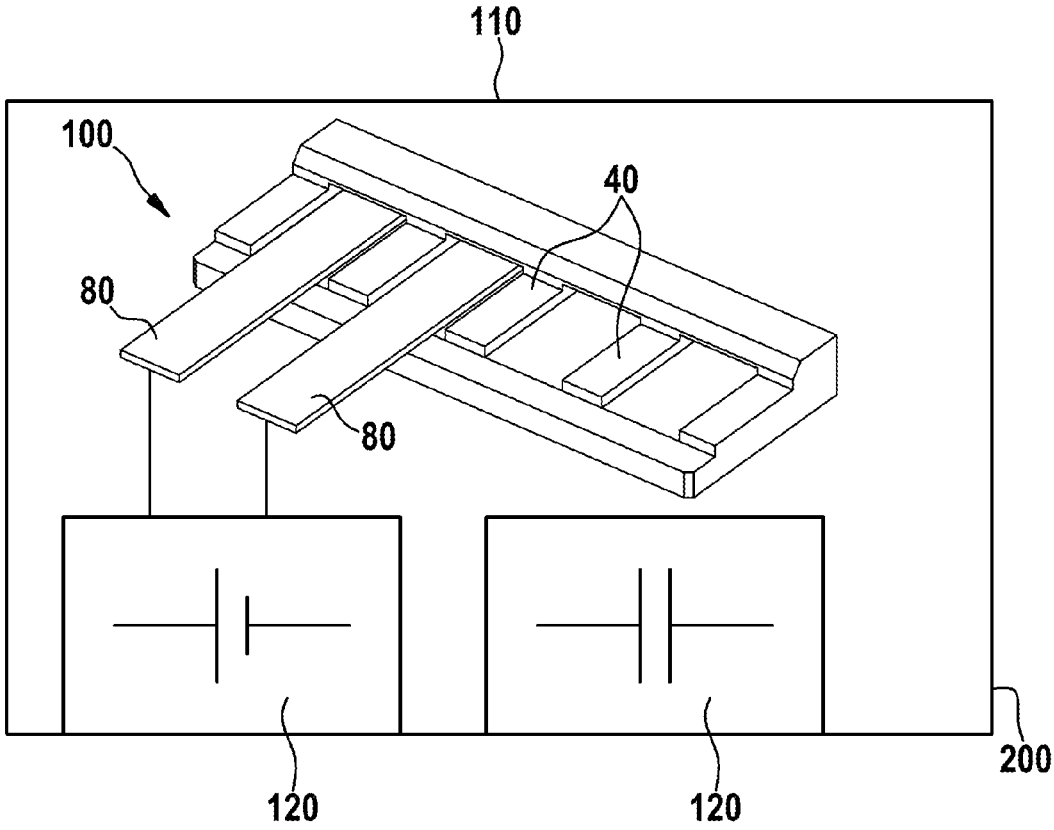
FIG. 5 shows an embodiment of an electrical device including an electrical termination unit.

FIG. 5 schematically depicts an embodiment of an electrical device 200 comprising an electrical termination unit 100 attached to a printed circuit board 110. The electrical device may be manufactured by performing the following steps with reference to the components of, e.g., FIG. 1. The electrical device 200 particularly is a microelectronic device intended for implantation into a human or animal body.

An insulating carrier 20 is molded with retention means 10 and alignment features 40 and provided with metal tabs 50. The retention means 10 are designed to position an xy-location of the wire 80, while maintaining z-axis contact against the free end 52 of the metal tab. The carrier 20 comprising the metal tabs 50 is attached to a printed circuit board 110. Wires 80 are attached to other components 120 such as, for example, feedthrough, battery capacitor, etc. A free end 82 of the flat wire 80 is inserted into the retention means 10 of the carrier 20 provided by a recess 30. The recess 30 secures the wire 80 against the metal tab 50 and maintains the proper position. An automated thermal process, such as, e.g., weld, braze, solder, is performed to metallurgically bond each wire 80 to the corresponding metal tab 50.

It is to be understood that more than one electrical termination unit 100 may be integrated into the electrical device 200.

It will be apparent to those skilled in the art that numerous modifications and variations of the described examples and embodiments are possible in light of the above teachings of the disclosure. The disclosed examples and embodiments are presented for purposes of illustration only. Other alternate embodiments may include some or all of the features disclosed herein. Therefore, it is the intent to cover all such modifications and alternate embodiments as may come within the true scope of this invention, which is to be given the full breadth thereof. Additionally, the disclosure of a range of values is a disclosure of every numerical value within that range.

We claim:

1. An electrical termination unit adapted for metallurgical connection with a microelectronic device, the electrical termination unit comprising:

a carrier;

at least one connection area within the carrier configured to retain an ancillary electrical lead of the microelectronic device when inserted therein in at least one spatial dimension;

an opening provided in the carrier;

at least one metal tab being attached to the carrier and extending through the at least one opening and having first and second free ends exposed at different sides of the carrier;

at least one alignment feature confining the at least one connection area on two sides and retaining the ancillary electrical lead in alignment with the at least one metal tab in a first plane; and at least one recess configured to confine the ancillary electrical lead in a plane perpendicular to the first plane to retain the ancillary electric lead in alignment with the at least one metal tab and enable physical connection between the at least one metal tab and the ancillary electrical lead;

wherein the at least one alignment feature and the at least one recess maintain alignment between the ancillary electrical lead and the at least one metal tab while the metallurgical connection is made; and wherein the at least one alignment feature is configured to provide a proper high-voltage separation distance.

2. The electrical termination unit according to claim 1, wherein the opening, the at least one metal tab, and the at least one connection area are configured to accommodate a flat shaped ancillary electrical lead.

3. The electrical termination unit according to claim 1, wherein the opening, the at least one metal tab, and the at least one connection area are configured to accommodate a round shaped ancillary electrical lead.

4. The electrical termination unit according to claim 1, further comprising:

an undercut disposed on at least one of the first free end and second free end; and a step formed in the opening, wherein the undercut and the step mechanically engage to prevent the at least one metal tab from slipping through the opening.

5. The electrical termination unit according to claim 1, wherein the at least one connection area comprises means for accommodating a free end of the ancillary electrical lead by way of an interference fit or a transition fit.

6. The electrical termination unit according to claim 5, wherein the at least one recess is arranged in a wall of the carrier in proximity of the at least one metal tab configured to receive the free end of the ancillary electrical lead and retain the ancillary electrical lead with the interference fit or with the transition fit.

7. The electrical termination unit according to claim 5, wherein the at least one metal tab is folded in a way to provide the at least one recess configured for receiving the free end of the ancillary electrical lead and retaining the free end with the interference fit or with the transition fit.

8. The electrical termination unit according to claim 5, wherein the at least one metal tab is forked to provide the at least one recess configured for receiving the free end of the ancillary electrical lead and retaining the free end with the interference fit or with the transition fit.

9. The electrical termination unit according to claim 5, wherein the at least one metal tab is provided with a pin configured to cooperate with an opening in the ancillary electrical lead for retaining the ancillary electrical lead with the interference fit or with the transition fit.

10. The electrical termination unit according to claim 1, further comprising a plurality of metal tabs arranged in the carrier equally spaced from one another.

11. An electrical device comprising a printed circuit board with at least one electrical termination unit according to claim 1, wherein at least one electrical lead of the printed circuit board is electro-mechanically connected to the at least one metal tab.

12. The electrical device according to claim 11, wherein the electrical device is a microelectronic device adapted for implantation into a human or animal body.

13. A method for manufacturing an electrical device comprising at least one electrical termination unit according to claim 1, by performing the steps:

providing a carrier and at least one metal tab;

forming the electrical termination unit by attaching the at least one metal tab to the carrier;

attaching the electrical termination unit to a printed circuit board;

attaching one or more wires connected to one or more components coupled to the printed circuit board to one or more retention means provided by the electrical termination unit to secure the one or more wires with an interference fit or with a transition fit to the retention means; and performing a thermal process for metallurgically bonding the one or more wires to the at least one metal tab.

14. The method according to claim 13, wherein the thermal process is performed in an automated way for metallurgically bonding a plurality of wires to the electrical termination unit.

15. The electrical termination unit according to claim 1, wherein the at least one connection area is configured to enable multiple metallurgical connections between a plurality of ancillary electrical leads and a plurality of metal tabs simultaneously.

* * * * *